US005462268A

United States Patent [19]

Remy et al.

[11] Patent Number: 5,462,268

[45] Date of Patent: Oct. 31, 1995

[54] DEVICE FOR TEMPORARY STORAGE OF FLAT OBJECTS

[75] Inventors: Jean-Luc A. M. Remy, Venelles; Jean Roch, Simiane Collongue; Jean-Pierre Volat, Aix en Provence, all of France

[73] Assignee: Bertin & Cie, Plaisir, France

[21] Appl. No.: 181,302

[22] Filed: Jan. 13, 1994

[30] Foreign Application Priority Data

Jan. 18, 1993 [FR] France ..... 93 00396

[51] Int. Cl.[6] ..... B65H 5/00

[52] U.S. Cl. ..... 271/225; 271/184; 271/69; 198/477.1

[58] Field of Search ..... 271/225, 292, 271/294, 295, 69, 184; 198/477.1

[56] References Cited

U.S. PATENT DOCUMENTS

| | | | |
|---|---|---|---|
| 2,761,680 | 9/1956 | Lens . | |
| 3,519,145 | 7/1970 | MacDonald . | |
| 5,362,040 | 11/1994 | Midavaine et al. | 271/292 X |

FOREIGN PATENT DOCUMENTS

| | | | |
|---|---|---|---|
| 480822 | 4/1992 | European Pat. Off. . | |
| 2677626 | 12/1992 | France . | |
| 1121866 | 1/1962 | Germany . | |
| 1249171 | 8/1967 | Germany . | |
| 1296099 | 5/1969 | Germany . | |
| 494362 | 3/1992 | Japan | 271/294 |

*Primary Examiner*—David H. Bollinger
*Attorney, Agent, or Firm*—Watson, Cole, Grindle & Watson

[57] ABSTRACT

A device is intended for receiving one by one from an entry conveyor (2) flat objects moving along in the same plane in a first direction and for displacing them one by one towards an exit conveyor (5) includes reception conveyor (11) including a plurality of receptacles (12) movable over at least a part of their path in a second direction (F1) substantially orthogonal to the the first direction (F2), each receptacle being capable of receiving a flat object bearing in a position which is slightly inclined with respect to vertical, and a stationary station (7) for reception and stopping in a position which is slightly inclined with respect to vertical of the flat objects originating from the entry conveyor. The stationary reception station (7) is interposed in the part of the path and has a form matching that of the receptacles (12) so that an object bearing on the reception station is transferred in the second direction (F1) bearing in a receptacle (12) upon passage of the latter in the plane of the reception station (7).

14 Claims, 5 Drawing Sheets

106
M
143

ℓ
141
101
112
131
144
142
107
F1
F1
L
102

206
213
F3
207
213
210
244
F1
245
201
212
212
202

214
208a
212
207
213

214
208b
210
244
245

DEVICE FOR TEMPORARY STORAGE OF FLAT OBJECTS

BACKGROUND OF THE INVENTION

1. Field of the Invention

The present invention relates to a device for temporary storage of flat objects, particularly for a postal sorting machine.

2. The Prior Art

In machines for postal sorting of flat objects, it is frequently necessary to temporarily and individually store the flat objects between an upstream part and a downstream part of the machine.

In a number of cases, it is necessary for the displacement of the flat objects in the temporary storage device to be synchronized between the entry and the exit. Each flat object originating from an upstream conveyor thus experiences a constant delay before being delivered to a downstream conveyor. The operation of such a device is thus of the delay line type.

Such a device is, in particular, described in Patent Application FR-A-2,677,626 and in European Patent Application EP-A-0,480,822.

According to Patent Application FR-A-2,677,626, the temporary storage device includes a rotary drum equipped at its periphery with several longitudinal grooves and arranged in the extension of an entry conveyor on which the flat objects travel one by one in a given direction in a plane which is slightly inclined with respect to the vertical. When a flat object leaves the entry conveyor, its longitudinal lower edge is received in one of the grooves of the drum and its rear face bears against one of the blades of a reception conveyor moved synchronously with the drum. When the drum rotates through a quarter turn, the flat object is maintained parallel to itself by matched advance of the reception conveyor and its lower edge is presented in a pinching zone between a ridge of the drum and a motorized roller which injects the object into the container of an exit conveyor located underneath. During this injection phase, the next groove of the drum is presented in the extension of the entry conveyor in order, there, to receive a further flat object bearing against another blade of the reception conveyor.

Such a device is suited to an operation of the delay line type, but it is not adapted to operation as a stacker/destacker, that is to say when the displacement of the flat objects between the entry and the exit of the device is not synchronized.

EP-A-0,480,822 also describes a temporary storage device of the delay line type using two motorized helical spirals which receive the flat objects traveling in a given direction in an entry conveyor one by one, displace them synchronously, one by one, in a direction orthogonal to their direction in the entry conveyor, and deliver them to an exit station where they are ejected individually into the containers of an exit conveyor located under the helical spiral device.

Such a device is difficult to produce in technical terms, particularly owing to the overhanging assembly of the helical spirals and the need to provide, between the entry conveyor and the helical spirals, orientable arms with drive belts which are capable of directing the flat objects one by one towards a suitable position along helical spirals. Moreover, as in the case of Patent Application FR-A-2,677,626, the device described in this document EP-A-0,480,822 can operate only in delay line mode.

U.S. Pat. No. 3,519,145 describes a temporary storage device consisting of two superposed wheels including radial fins which are uniformly distributed and define, in pairs, compartments capable of receiving flat objects. The two coaxial and superposed wheels are separated by a disk equipped with a slot and a second disk also equipped with a slot is provided under the lower wheel. The two wheels and the intermediate disk are motorized, while the lower disk is stationary. During rotation of the upper wheel, the radial compartments move along in front of an entry conveyor from which they receive letters one by one. By means of an appropriate control of the rotation of the wheels and of the intermediate disk, letters originating from the entry conveyor may be transferred from the upper wheel to the lower wheel through the slot in the intermediate disk, and from the lower wheel towards an exit conveyor through the slot in the stationary lower disk.

Such a device operates in stacker/destacker mode, that is to say the upper wheel receives the letters at the rate of the entry conveyor and that the lower wheel delivers them at the rate of the exit conveyor. The device thus acts as a buffer in which flat objects can remain for variable periods if the entry rate and the exit rate are not synchronized.

Of course, by means of a suitable control of the movement of the two wheels and of the intermediate disk, such a device can also operate in delay line mode if the entry rate and the exit rate have to be synchronized.

However, owing to its design, the device in document U.S. Pat. No. 3,519,145 presents a number of limitations. Thus, its storage capacity is a function of the number of compartments included by the wheels, which compartments have to be sufficiently narrow in order to maintain the letters in a substantially vertical position while having an entry opening of sufficient width to ensure the introduction of the letters originating from the entry conveyor one by one. The increase in the storage capacity thus results in an increase in the diameter of the wheels and a decrease in the angle at the center formed between the walls of a compartment, but this increase rapidly leads to a considerable overall size for the device. The increase in the diameter of the wheels is also reflected in an increase in weight which is liable to pose problems of inertia for the step-by-step driving of the upper wheel in synchronization with the entry conveyor and of the lower wheel in synchronization with the exit conveyor. Moreover, the cylindrical configuration of this temporary storage device offers no possibility of modulation as a function of the space available between entry conveyor and exit conveyor, which can vary from one machine to another. Finally, the letters have to be discharged towards the exit conveyor without the possibility of being directed towards another direction, for example in the event of address non-recognition.

The invention aims to provide a temporary storage device which, according to the particular embodiment given thereto, can operate in delay line mode or in stacker/destacker mode and the configuration of which can easily be adapted as a function of the space available for its installation.

A further object of the invention is to provide such a device which, without damage, makes it possible to transfer individually, at a high rate and in a sure manner, flat objects from an entry conveyor, on which the objects move along in the same plane in a given direction, towards an exit conveyor.

A further object of the invention is to supply such a storage device which has a simple design and is inexpensive, while offering great operational reliability at a high rate for objects with weights and dimensions which can vary within wide margins.

SUMMARY OF THE INVENTION

These objects and others are achieved by means of a temporary storage device intended for receiving flat objects moving along in the same plane in a first direction one by one from an entry conveyor and for displacing them one by one towards an exit conveyor, characterized in that it comprises:

a reception conveyor comprising a plurality of receptacles movable over at least a part of their path in a second direction substantially orthogonal to the first direction, each receptacle being capable of receiving a flat object bearing in a position which is slightly inclined with respect to the vertical, and a stationary station for reception and stopping in a position which is slightly inclined with respect to the vertical of the flat objects originating from the entry conveyor, the stationary reception station being interposed in the part of the path and having a form matching that of the receptacles so that an object bearing on the reception station is transferred in the second direction bearing in a receptacle upon passage of the latter in the plane of the reception station.

According to one characteristic of the invention, the movement of the receptacles and the movement of the flat objects in the entry conveyor are synchronized in order to transfer a flat object from the reception station to a receptacle in the time interval separating the arrivals in the reception station of the flat object and of the next flat object.

According to a further characteristic of the invention, the stationary reception station comprises a plate arranged in the orientation which is slightly inclined with respect to the vertical and which has several mutually parallel cuts extending from one of its edges and each receptacle comprises a comb, the parallel teeth of which are arranged so as to be able to pass through the cuts.

Thus, according to the overall size requirements, the reception conveyor may be designed so that the receptacles describe their movement in a horizontal plane or in a vertical plane. The length of the conveyor and, consequently, the storage capacity of the device may, all things being otherwise equal, be optimized as a function of these overall size constraints. Finally, according to whether the receptacles have a synchronous or nonsynchronous movement and, in this latter case, in one single direction or alternately in one direction or in the other, the storage device according to the invention may be adapted in order to function in delay line mode, in stacker/destacker of FIFO ("First in First out") type mode, or in stacker/destacker of FILO ("First in last out") type mode.

Further characteristics and advantages of the invention will emerge from the description which will follow of embodiments given solely by way of examples and illustrated by the appended drawings.

DETAILED DESCRIPTION OF THE PREFERRED EMBODIMENTS

Figure 1:
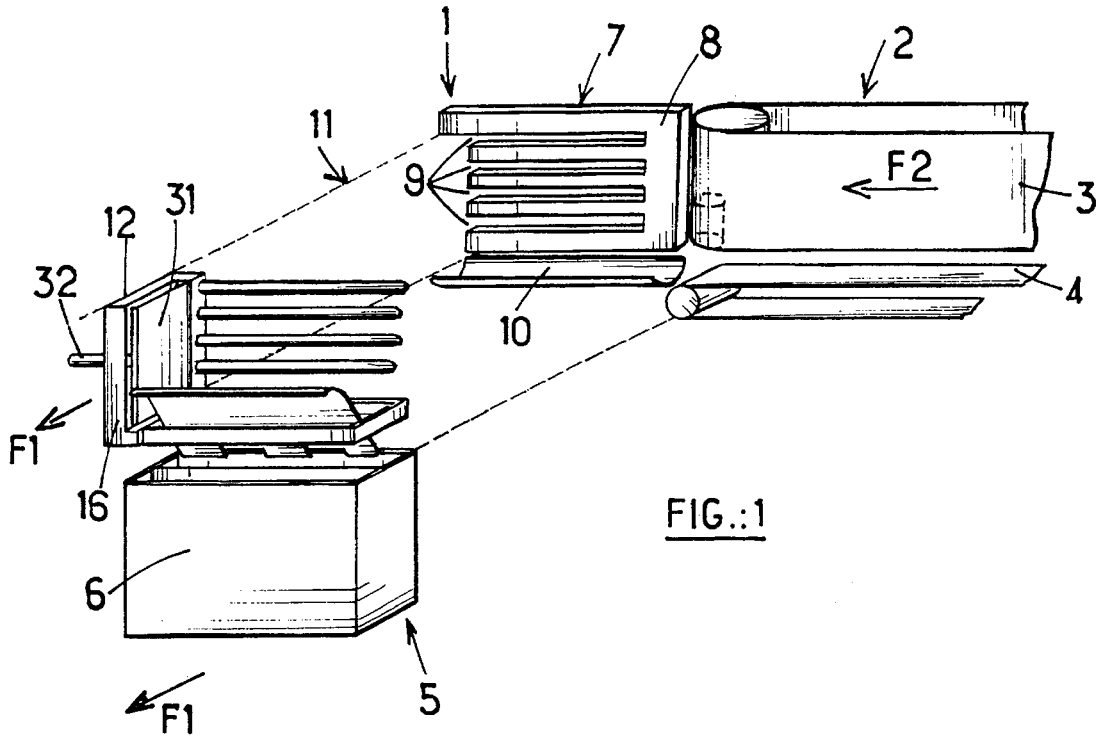
FIG. 1 is a diagrammatic exploded perspective view of a part of a temporary storage device according to a first embodiment of the invention.

With reference, firstly, to FIG. 1, a device 1 for temporary storage of flat objects is interposed between an entry conveyor 2 with belts 3 and 4 and an exit conveyor 5 with containers 6.

The temporary storage device 1 comprises a stationary reception and stopping station 7 including a plate 8 which is slightly inclined with respect to the vertical by an angle preferably between 10° and 20° and arranged in the extension of the entry conveyor 2. The plate 8 has horizontal cuts 9 extending over the greater part of its length from its lateral edge opposite the entry conveyor 2. An articulated and motorized flap 10 having a concavity which faces upwards is arranged horizontally along the lower edge of the plate 8 so as to project from the front face side of this plate, which is the one visible in FIG. 1.

Figure 6:
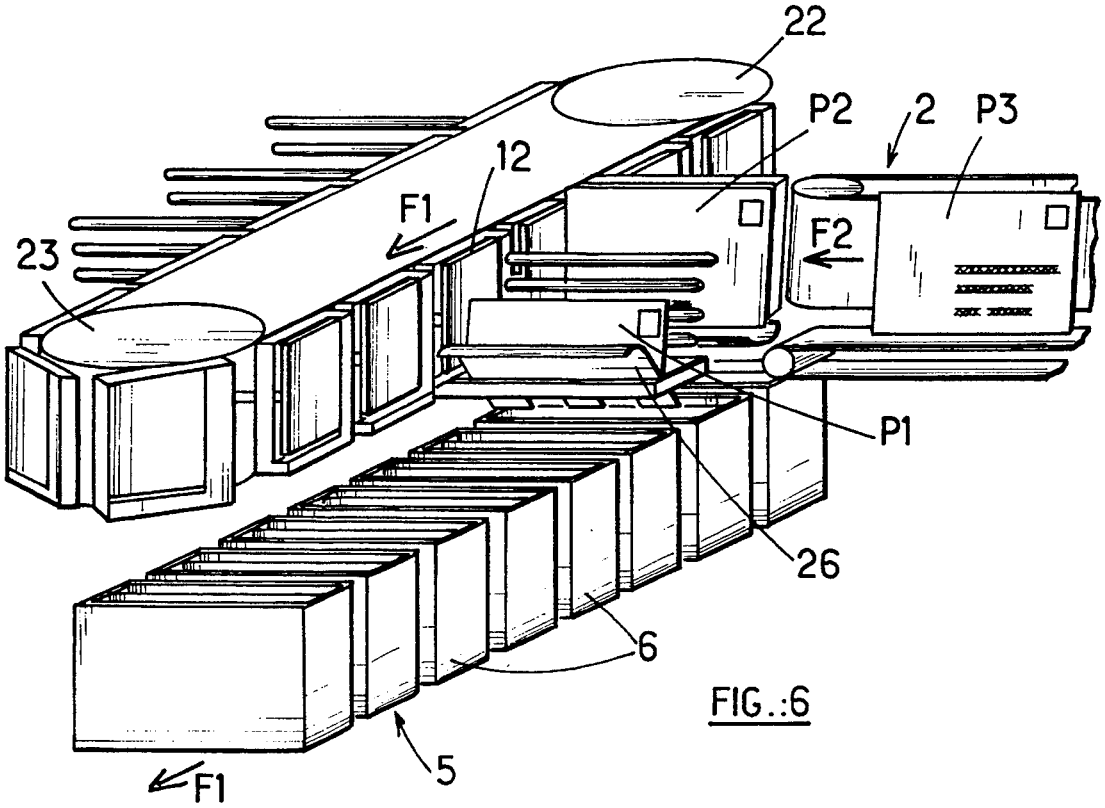
FIG. 6 is an overall perspective view showing the temporary storage device in a third position.

The temporary storage device 1 also includes a reception conveyor 11 consisting of several carriages 12 (only one of which is shown in FIG. 1) which are driven along a closed-loop horizontal path, as shown in FIG. 6.

Figure 2:
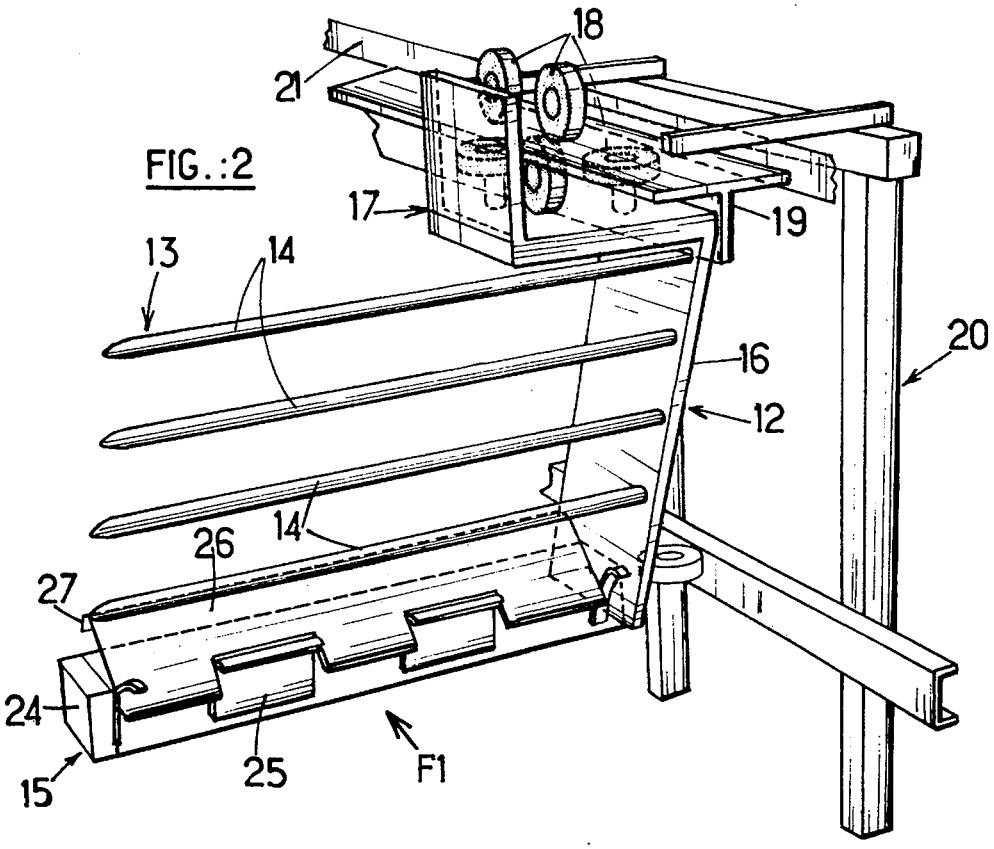
FIG. 2 is a more detailed perspective view of the carriage of the storage device in FIG. 1.
Figure 3:
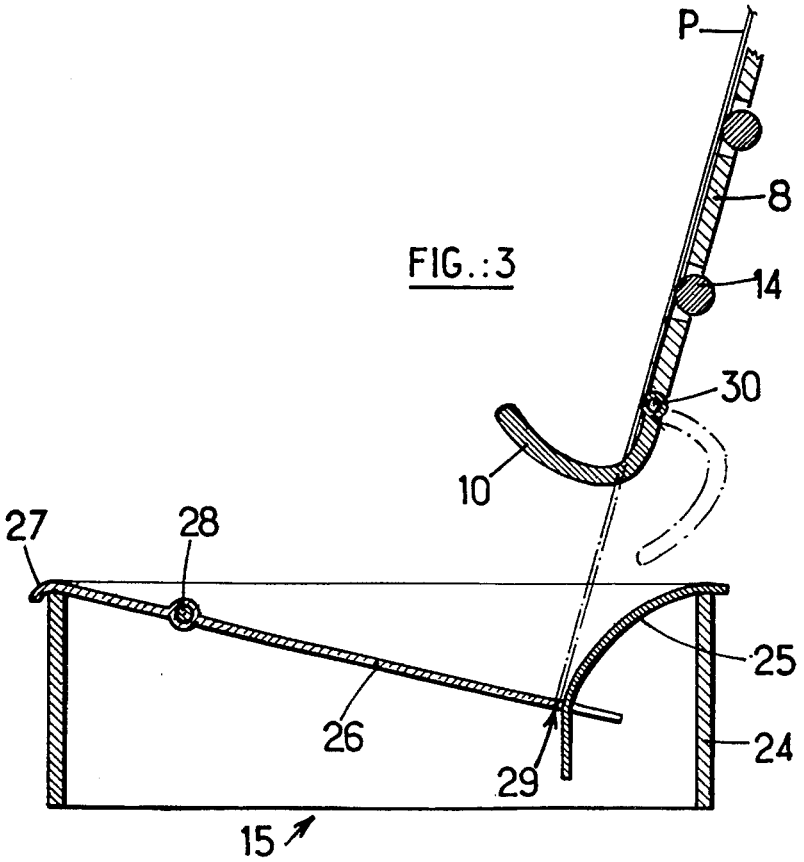
FIG. 3 is a partial view in lateral elevation of a carriage being presented at the stationary reception station in order, there, to take a flat object on passing.

As shown in FIGS. 1 to 3, each carriage 12 comprises a receptacle defined by a comb 13, the teeth 14 of which are horizontal, and by means 15 for retaining the lower longitudinal edge of the flat object intended to be received in the receptacle.

The dimensions and the spacing of the teeth 14 of the comb 13 are chosen so that said teeth are able to pass through the cuts 9 in the plate 8 during the gripping travel of the carriages 12 in the direction F1, which is orthogonal to the direction F2 of displacement of the flat objects on the entry conveyor 2. Moreover, the number of teeth and the spacing between teeth are chosen so as to ensure the holding in the receptacle of objects throughout the range of permissible dimensions, it being understood that the smallest object must bear at at least two zones over its height.

The teeth 14 of the comb 13 and the retention means 15 are carried by a bracket 16 which is itself suspended from a structure 17 with rollers 18 for rolling and guiding over a T-rail 19 forming part of the structure 20 of the reception conveyor 11. The rolling and guiding structure 17 is coupled to a drive means 21 such as a chain or a cable passing over a motor wheel 22 and a return wheel 23 (FIG. 6).

The retention means 15 of the carriages 12 are arranged horizontally under the lower tooth 14 of the comb 13 at a sufficient distance from this tooth to allow a passage to the lower part of the plate 8 and to the flap 10 when the carriage 12 passes into the plane of the reception station 7. The retention means 15 comprise a frame 24 carrying a stationary flap 25 arranged horizontally, the lower part of which extends substantially in the plane of the comb 14, while its upper part is curved rearwards with respect to the plane of the comb 13, seen in the direction F1 of advance of the carriage. This part which is curved rearwards is intended to prevent light and deformable objects from escaping outside the receptacle under the lower tooth of the comb. The retention means 15 comprise a second substantially plane flap 26 ending in a rim 27 which is folded downwards on the carriage front side. The flap 26 is articulated about a rotation shaft 28 enabling it to tilt between a position which is slightly inclined with respect to the horizontal, as shown in FIG. 3, and a highly inclined position in which the flaps 25 and 26 together delimit a slot for ejection of a flat object under gravity. In the position of reception and retention of a flat object shown in FIG. 3, the flaps 25 and 26 define a dihedron of horizontal edge 29, which is open towards the top, in which the lower edge of a flat object P taken from the reception station 7 comes to bear.

The motorized flap 10 of the reception and stopping station 7 is articulated about a horizontal shaft 30 so as to be able to tilt very rapidly between the retention position, shown in solid lines, and the position of release of an object, shown in dot-dash lines, in FIG. 3. The shape and the dimensions of the flap 10 and its relative position with respect to the retention means 15 are chosen so as to permit its retraction rearwards when a carriage 12 is presented substantially in the plane of the reception and stopping station 7. Thus, owing to its rearward tilting movement, the flap 10 releases the lower edge of a flat object P which can thus fall substantially parallel to itself into the above-mentioned dihedron, while bearing via its rear face against the comb 13 which, like the plate 8, is substantially inclined with respect to the vertical by an angle between approximately 10° and 20° so as to ensure the flat objects are held in position under gravity on the receptacles of the carriages.

The tilting of the flaps 10 and 26 is controlled by conventional motorization means which are not shown, for example a stepping motor for the flap 10 and a spring and electromagnet mechanism for each flap 26.

As shown in FIG. 1, each carriage 12 has associated with it a movable jogging plate 31 connected to the support bracket 16 by a damper 32, for example of hydraulic type. The jogging plate is arranged in a vertical plane perpendicular to the plane of the associated comb 13 and extends forwards with respect to the latter so that the plate 31 projects on the front side of the plate 8 when the comb of the corresponding carriage is still to the rear of this plate.

Figure 4:
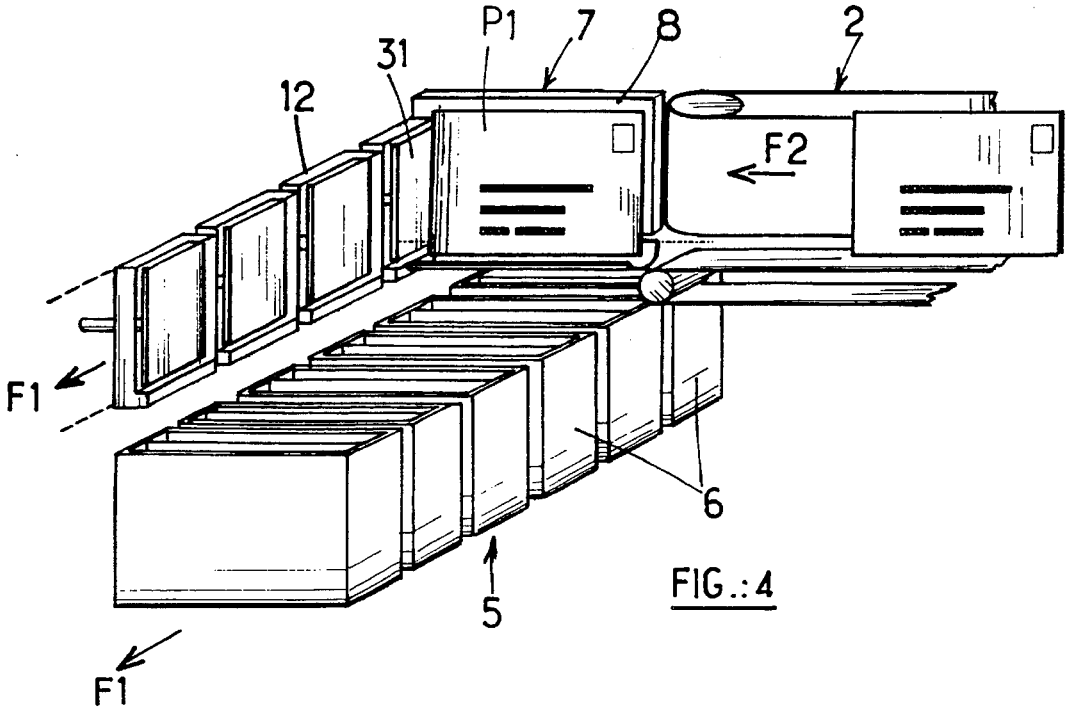
FIG. 4 is an exploded partial perspective view showing the temporary storage device in a first position.

Thus, as shown in FIG. 4, when a first flat object P1 is ejected by means of inertia from the entry conveyor 2 towards the reception and stopping station 7, the jogging plate 31 of a carriage 12 is already located in position for intercepting the path of the object P1, while the comb of the same carriage is still located to the rear of the plate 8. Preferably, the conveyor 2 includes at the exit a motorized pulley or the like, shown in dot-dash lines in FIG. 1 and pinching the flat objects in order to introduce them completely into the reception station 7. The flat object P1, which was conveyed at the exit of the entry conveyor 2 substantially with the same inclination as that of the plate 8, finishes its travel in the reception and stopping station 7 where it is braked by friction on the plate 8 and its front edge is immobilized against the jogging plate 31 by virtue of the associated damper 32 which preferably has a damping frequency of the order of 0.3 Hertz. During its advance in the direction of the arrow F1, the carriage 12 arrives substantially in the plane of the plate 7 and, as described above, the flap 10 tilts downwards and releases the flat object P1 which is received in the retention means 15 of the carriage 12, as shown in FIG. 5 (in which, as is the case in FIGS. 4 and 6, all the combs have not been shown for reasons of clarity).

Of course, the movement of the carriages 12 and the movement of the flat objects in the entry conveyor 2 are synchronized in order to transfer a flat object from the reception station 7 into a receptacle of carriage 12 in the time interval separating the arrivals in the reception station 7 of this flat object and of the next flat object. This synchronization is ensured, for example, by controlling, by conventional means, the displacement of the carriages 12 at constant speed and by slaving the introduction of a flat object into the entry conveyor 2 as a function of the passage of a carriage 12 via a specific position.

Figure 5:
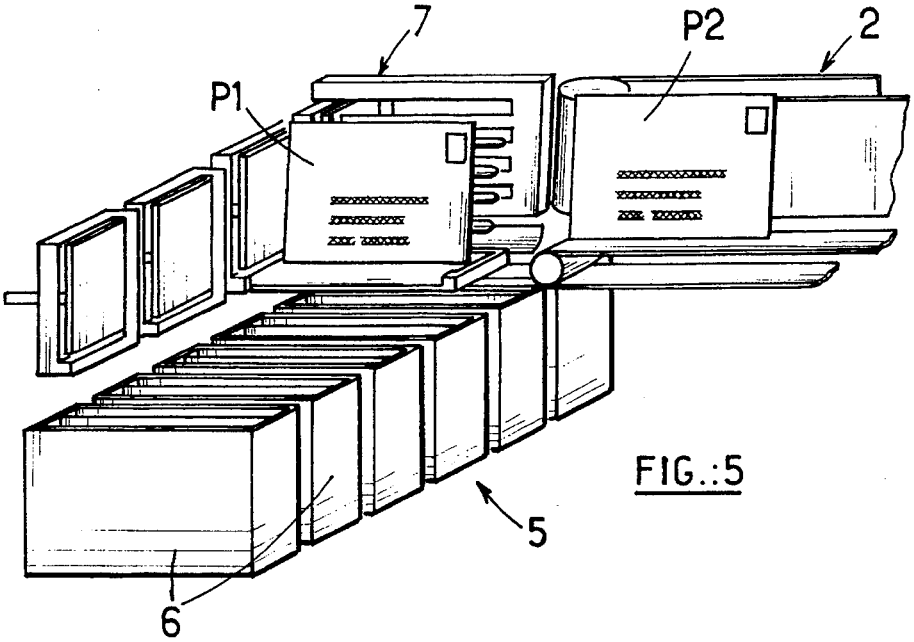
FIG. 5 is a view similar to FIG. 4, showing the temporary storage device in a second position.

In FIG. 5, the flat object P1 has been disengaged from the reception and stopping station 7 and a second flat object P2 is about to arrive there, originating from the entry conveyor 2.

In FIG. 6, the object P1 is being introduced under gravity into a container 6 of the exit conveyor 5 through the effect of tilting of the flap 26 which has released the lower edge of the object P1. During the same period, an object P2 is being gripped by the next carriage, while a third object P3 is still on the entry conveyor 2. The carriages 12 are synchronized in terms of speed and phase with the containers 6 of the exit conveyor 5.

The temporary storage device which has just been described with respect to FIGS. 1 to 6 has an operation of the line delay type, that is to say that all the objects are delivered to the exit conveyor with a constant delay with respect to their entry into the device. By way of example, a device as described above makes it possible to process objects having a maximum length of 381 mm, and a maximum thickness of 20 mm with a conveying speed on the entry conveyor 2 equal to 1.85 meters/second. For comb teeth having a thickness of 10 mm, the minimum disengagement time is 70 milliseconds, which makes it possible to disengage the thickest object (20 mm) while having a safety margin of 10 mm before the injection of the next object. This time makes it possible to accept instances of a lack of synchronization between objects (advance or delay of the object) within a range of 120 milliseconds (+ 50 milliseconds, −70 milliseconds).

However, the device makes it possible to accept higher rates with higher conveying speeds which may reach approximately 3 m/s on the entry conveyor 2, while preserving the vertical and horizontal jogging of the objects, for weights of up to approximately 1 kg. The device described also has the advantage of accepting batches of objects without risk of jamming.

Figure 7:
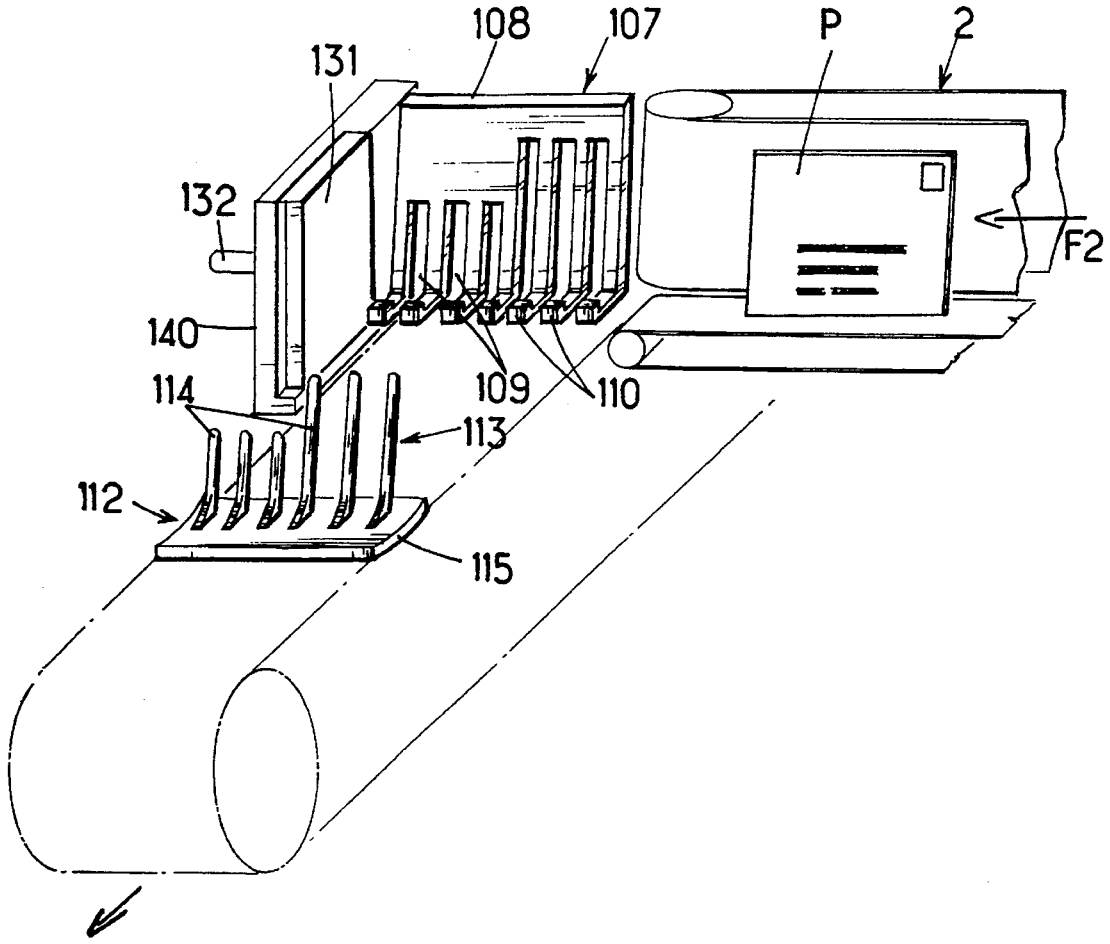
FIG. 7 is an exploded diagrammatic perspective view of a temporary storage device including a stationary reception station and movable carriages according to a second embodiment of the invention.

Reference will now be made to FIG. 7 which illustrates a variant embodiment in which the elements which are similar but of different form from those shown in FIGS. 1 to 6 are denoted by the same reference increased by the number 100.

The temporary storage device in FIG. 7 differs essentially from that shown in FIGS. 1 to 6 in that the carriages 112 are displaced in a plane which is vertical instead of being horizontal, the teeth 114 of the combs 113 being arranged in vertical planes, while the overall plane of the comb preserves a rearward inclination between approximately 10° and 20°. Similarly, the cuts 109 in the plate 108 of the reception and stopping station 107 are arranged in vertical planes and the lateral jogging plate 131 is stationary and forms part of the reception and stopping station 107. This jogging plate 131 is mounted on a stationary support 140 by means of a hydraulic damper 132 of the same type as the dampers 32, but with a damping frequency at least equal to the rate of the objects originating from the conveyor 2.

On the reception and stopping station 107, the means for retaining the lower longitudinal edge of the flat objects consist of stationary lugs 110 formed by parts of the plate which are curved substantially horizontally forwards and end in a rim turned upwards and intended to retain and guide the lower edge of the objects when these are received. The lugs 110 are separated by the cuts 109 which extend from the bottom of the plate 108. These cuts 109 preferably have different heights, the three cuts closest to the entry conveyor 2 having, for example, a height greater than the three cuts which are furthest away, as shown in FIG. 7. Similarly, the teeth 114 of the combs 113 have different heights which are chosen so as to retain objects over the entire range of permissible dimensions and to permit the passage of the comb through the reception plate 108. These teeth of reduced height are intended to facilitate, downstream, the seizing of objects outside the carriages by a mechanism of which an example will be given with respect to FIG. 8.

The retention means 115 consist of a plane or slightly concave plate preferably having an adherent upper surface from which extend the comb teeth 114. The foot of each tooth 114 is equipped with a wedge-shaped shoe of appropriate height and slope to disengage the lower edge of a flat object over the upward-turned rims of the plate 108 during disengagement of this object by a carriage 112.

The operation of the device in FIG. 7 is similar to that described with respect to FIGS. 1 to 6, the only difference being that the releasing of the lower edge of a flat object located on the reception station 7 takes place by means of simple lateral translation of the lower edge of the object through the effect of the driving of the comb 113, until the lower edge falls from the lug 110 onto the retention plate 115, the adherent surface of which prevents the object from sliding, whereafter the object is taken over by the carriage which has received it.

The discharge of the object towards an exit conveyor cannot take place under gravity since the retention means 115 are not equipped with a hatch and different articulated means for taking with arms and suckers or suction belts may be provided, an example of which will be given in connection with FIG. 8 to which reference will now be made.

Figure 8:
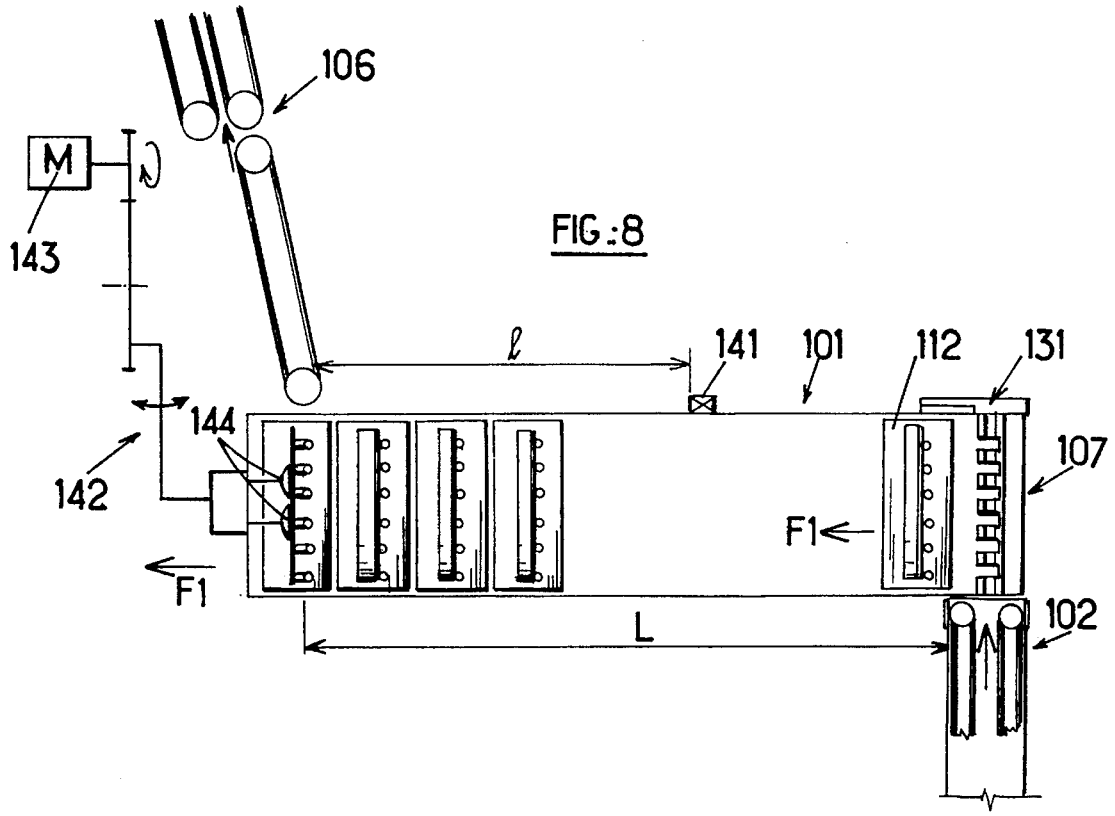
FIG. 8 is a diagrammatic plan view of a temporary storage device according to the embodiment in FIG. 7 and adapted in order to operate in stacker/destacker of the FIFO type mode.

In the example of FIG. 8, the temporary storage device 101 operates in the stacker/destacker of FIFO type mode, namely a mode in which the first flat object entering into the device is the first to exit therefrom.

This device 101 is of the type described in FIG. 7 in which, moreover, the carriages 112 are controlled step-by-step in order to be presented at the reception and stopping station 107 in synchronization with the arrival of an object. They are then disconnected from their drive means at 141 by any appropriate known means, such as, for example, the mechanisms used for disconnecting the cabins of a gondola lift at the ascent and descent stations for the users. From the station 141, the carriages 112 are thus advanced over a distance I at reduced speed and bear against one another so that the exit conveyor 106 is supplied at constant pace for a supply of the device 101 by the entry conveyor 102 which may have variable pace ("pace" is used to describe the nominal time interval separating the passage of two consecutive objects via the same position).

The flat objects are discharged outside the device 101 by means of a destacking mechanism 142 comprising an arm capable of performing movements both in the direction F1 in one direction and in the other and in a vertical plane inclined on this direction. This arm moved by a motor 143 carries suckers 144 which are applied against the flat object to be seized during its advance at low speed by the carriage 112 which carries it. During this gripping phase, the arm of the mechanism 142 travels in the direction of the arrow F1 in order to accompany the movement of the object and of the carriage which carries it, then the arm performs a lateral movement which has the effect of allowing the flat object to escape from the comb of the carriage and be presented at the entry of the exit conveyor 106. Such a destacking mechanism with an arm having reciprocating movement and suckers is described, in particular, in French Patent No. 2,615,840, to which reference may be made.

Destacking mechanisms of other types may be used to extract the flat objects from the storage device 101, for example a mechanism with suction belts which is mounted so as to oscillate in order to be able to accompany the displacement of the flat object during its seizing on the carriage. Such a mechanism comprises at least two horizontal belts arranged in a substantially vertical plane and the dimensions and the spacing of which permit the passage of the comb of the carriages. In this case, of course, the combs will have to have horizontal teeth as in the example of FIGS. 1 to 6.

After their passage via the zone for destacking flat objects, the carriages 112 are connected as far as a storage zone located at the lower part of the conveyor and not visible in FIG. 8. From this storage zone, the carriages are again connected so as to be presented at the reception and stopping station 107 in synchronization with the arrival of an object as indicated above.

Figure 9:
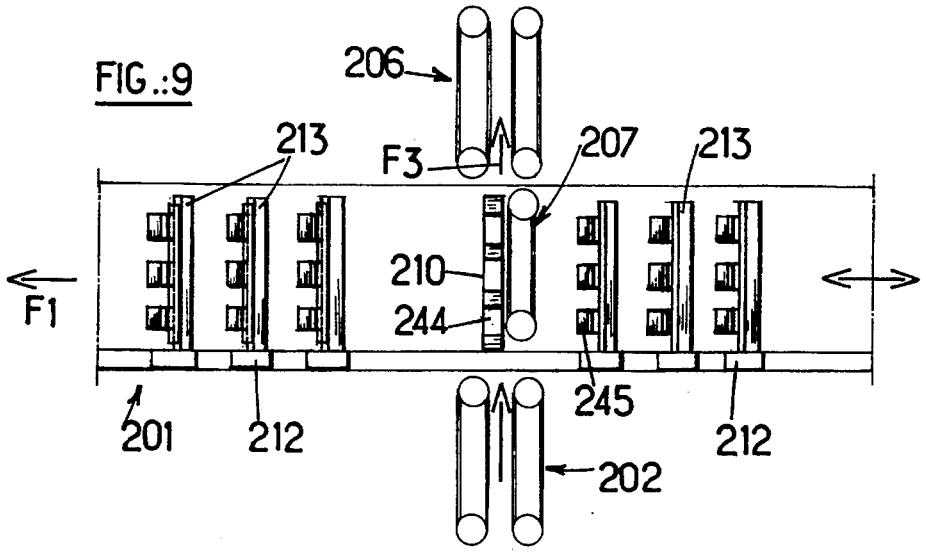
FIG. 9 is a diagrammatic plan view of a temporary storage device according to a further embodiment of the invention and adapted in order to operate in stacker/destacker of the FILO mode.
Figure 10:
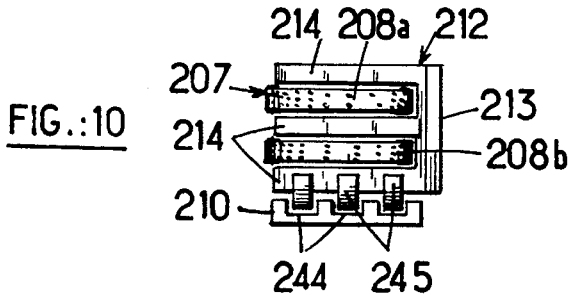
FIG. 10 is a diagrammatic view in elevation of the reception station and of a carriage of the temporary storage device in FIG. 9.

FIG. 9 shows a further embodiment of the temporary storage device in which it operates in stacker/destacker of FILO type mode, that is to say the first object entering into the device is the last to exit therefrom.

In this example, the plate of the reception and stopping station 207 consists of two perforated suction belts **208*a*–208*b* arranged horizontally so as to be able to pass between the teeth 214 of the combs 213 when the latter pass into the plane of the reception and stopping station 207. The belts 208*a*–208*b* are moved intermittently as will be described below. The reception and stopping station 207 is supplemented by a means 210 for bearing of the lower longitudinal edge of the flat objects, this means 210 consisting of a stationary plate provided with notches 244 in which shoes 245 carried by the combs 213 at their lower part can engage. Thus, upon passage of a carriage 212 into the plane of the reception and stopping station 207, the shoes 245 come to engage under the lower edge of the flat object resting on the plate 210 and this object is thus disengaged laterally outside the reception station 207**.

In operation, the objects originating from the entry conveyor 202 arrive one by one at the reception and stopping station 207 where they are taken away one by one by the carriages 212 which are being displaced in the direction of the arrow F1 (FIG. 9). A buffer stock of flat objects is thus constituted downstream of the reception station 207, in the direction of the arrow F1. Throughout all this reception phase, the belts 208*a* and 208*b* are stopped and no partial vacuum is applied to them. When the buffer stock has to supply the exit conveyor 206, the carriages 212 are moved in the opposite direction and the perforated belts 208*a* and 208*b* are driven in the direction indicated by the arrow F3. A flat object brought to bear against these belts by a carriage 212 is pressed against the belts through the effect of the partial vacuum which is then applied to them, and is then driven towards the exit conveyor 206. By virtue of a conventional disconnection and connection mechanism of the type indicated above, destacking of the objects towards the exit conveyor can take place at constant pace, independently of the pace between the objects during stacking. In this embodiment, the reception and stopping station 207 thus acts both as a stacking and destacking means according to the operating phase of the device.

Of course, the embodiments described are only examples and they could be modified, particularly by substituting technical equivalents, without thereby departing from the scope of the invention.

We claim:

1. Device for temporary storage of flat objects arranged between an entry conveyor, in order to receive therefrom, one by one, flat objects moving along in the same plane in a first direction, and an exit conveyor towards which said storage device displaces said flat objects received from the entry conveyor one by one, in which said storage device comprises:

a reception conveyor comprising a plurality of receptacles movable over at least a part of their path in a second direction substantially orthogonal to said first direction, each receptacle being capable of receiving a flat object bearing in a position which is slightly inclined with respect to vertical, and a stationary station for reception and stopping in a position which is slightly inclined with respect to vertical of said flat objects originating from said entry conveyor, said reception station being interposed in said part of the path and having a form matching that of said receptacles so that an object bearing on said reception station is transferred in said second direction bearing in one of said receptacles upon passage of the latter in the plane of said reception station.

2. Device according to claim 1, comprising means for synchronizing the movement of said receptacles and the movement of said flat objects in said entry conveyor in order to transfer a flat object from said reception station into one of said receptacles in the time interval separating the arrival in said reception station of a flat object and of a next flat object.

3. Device according to claim 1, in which said stationary reception station comprises a plate arranged in said orientation which is slightly inclined with respect to vertical, said plate having several mutually parallel cuts extending from one edge thereof and each of said receptacles comprising a comb having parallel teeth which are arranged so as to be able to pass through said cuts when said receptacle moves over said part of said path.

4. Device according to claim 3, in which said plate and said comb comprise at their lower part means for retaining the lower longitudinal edge of said flat objects.

5. Device according to claim 4, in which said cuts and said teeth are horizontal.

6. Device according to claim 5, in which said retaining means associated with said plate comprise a first movable flap and means for displacing said first flap between a position for retaining an object on said reception station and a retracted position of release of said object towards the retaining means associated with one of said receptacles.

7. Device according to claim 6, in which said retaining means associated with each of said of receptacles comprise a second movable flap and means for displacing said second flap between a position of retention of an object on said receptacle and a retracted position of release under gravity of said object towards said exit conveyor.

8. Device according to claim 5, in which each of said receptacles has associated with it a movable stop piece for the front edge of said flat objects and damping means interposed between said movable stop piece and support means of said receptacle.

9. Device according to claim 4, in which said cuts and said comb teeth are arranged in a vertical plane.

10. Device according to claim 9, in which said retaining means consist, respectively, of lugs projecting forwards at the lower part of said plate and of a concave plate supporting each comb.

11. Device according to claim 9, in which said stationary reception station associated with said plate comprises a movable stop piece for the front edge of said flat objects and damping means interposed between said movable stop piece and a stationary support.

12. Device according to claim 1, in which said receptacles are mounted on drive means for synchronously driving said receptacles over said path.

13. Device according to claim 1, in which said receptacles consist of carriages associated with a drive mechanism comprising means for driving said carriages over said path and disconnection means capable of disconnecting said carriages from said driving means for ensuring a nonsynchronous displacement of said carriages.

14. Device according to claim 13, in which said drive mechanism is adapted in order to drive said carriages selectively in one direction and in the opposite direction.

* * * * *